US012455129B2

(12) United States Patent
Kim

(10) Patent No.: US 12,455,129 B2
(45) Date of Patent: Oct. 28, 2025

(54) RECIPROCATING AMBIDEXTROUS MAGAZINE RELEASE SYSTEM

(71) Applicant: Kyung Tae Kim, Laguna Niguel, CA (US)

(72) Inventor: Kyung Tae Kim, Laguna Niguel, CA (US)

( * ) Notice: Subject to any disclaimer, the term of this patent is extended or adjusted under 35 U.S.C. 154(b) by 0 days.

(21) Appl. No.: 18/811,760

(22) Filed: Aug. 21, 2024

(65) Prior Publication Data

US 2025/0067531 A1 Feb. 27, 2025

Related U.S. Application Data

(60) Provisional application No. 63/534,342, filed on Aug. 23, 2023.

(51) Int. Cl.
*F41A 35/06* (2006.01)
*F41A 9/59* (2006.01)
*F41A 17/38* (2006.01)

(52) U.S. Cl.
CPC ..... *F41A 9/59* (2013.01); *F41A 17/38* (2013.01); *F41A 35/06* (2013.01)

(58) Field of Classification Search
CPC ..... F41A 9/59; F41A 17/38; F41A 35/06
See application file for complete search history.

(56) References Cited

U.S. PATENT DOCUMENTS 4,236,337 A * 12/1980 Beretta ..... F41A 35/06 42/7
4,521,985 A * 6/1985 Smith ..... F41A 17/38 42/7
4,573,280 A * 3/1986 Malhotra ..... F41A 17/38 42/7
4,615,134 A * 10/1986 Beretta ..... F41A 35/06 42/72
4,713,902 A * 12/1987 Wigton ..... F41A 35/06 42/7
4,759,144 A * 7/1988 Egan ..... F41A 35/06 42/7
4,835,892 A * 6/1989 Ruger ..... F41A 17/38 42/7
6,141,895 A * 11/2000 Rost ..... F41A 17/38 42/6
8,166,691 B1 * 5/2012 Karfiol ..... F41A 17/38 42/6
9,964,372 B1 * 5/2018 O'Clair ..... F41A 35/06
10,161,701 B2 * 12/2018 Paquette ..... F41A 17/38
10,415,913 B2 * 9/2019 Wyssen ..... F41A 35/06
12,078,440 B2 * 9/2024 Gibbens ..... F41A 9/59
2007/0169390 A1 * 7/2007 Bubits ..... F41A 35/06 42/49.01
2015/0323271 A1 * 11/2015 McGinty ..... F41A 17/38 42/17
2017/0199000 A1 * 7/2017 Paquette ..... F41A 17/38
2018/0347925 A1 * 12/2018 Gibbens ..... F41A 9/59

FOREIGN PATENT DOCUMENTS

CH 713208 A2 * 6/2018 ..... F41A 35/06
WO WO-2005124263 A1 * 12/2005 ..... F41A 35/06

* cited by examiner

*Primary Examiner* — Gabriel J. Klein

(57) ABSTRACT

A firearm ambidextrous magazine release utilizing a reciprocating action mechanism. In some embodiments a firearm ambidextrous magazine release configured to be utilized in Glock type firearms.

2 Claims, 7 Drawing Sheets

Detail A

Detail B

Detail C

RECIPROCATING AMBIDEXTROUS MAGAZINE RELEASE SYSTEM

This application also claims priority to U.S. provisional application 63/534,342, filed Aug. 23, 2023.

FIELD OF THE INVENTION

The field of the invention is firearm magazine release mechanisms.

BACKGROUND

A popular firearm design does not incorporate an ambidextrous magazine release (i.e.—the firearm can be configured for magazine ejection using either the right or left thumb, but not both).

SUMMARY OF THE INVENTION

A Reciprocating Ambidextrous Magazine Release System (RAMRS) (present invention) provides for ejection of magazines with either thumb or by a pinching motion of thumb and finger. Additionally, the invention could be configured as an easy "Drop-In" type of system/modification where no alteration (except for the "dropping in" of the parts) of the firearm from original factory configuration is required.

Various objects, features, aspects and advantages of the inventive subject matter will become more apparent from the following detailed description of preferred embodiments, along with the accompanying drawing figures in which like numerals represent like components.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Parts named Right/Left Thumb Actuator is not intended to construe that these parts can only be actuated via use of a Thumb.

DETAILED DESCRIPTION

The following discussion provides many example embodiment/s of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

All figures show only approximate representations of the components of the system/s and may not be accurate in scale and/or positions.

Figure 1:
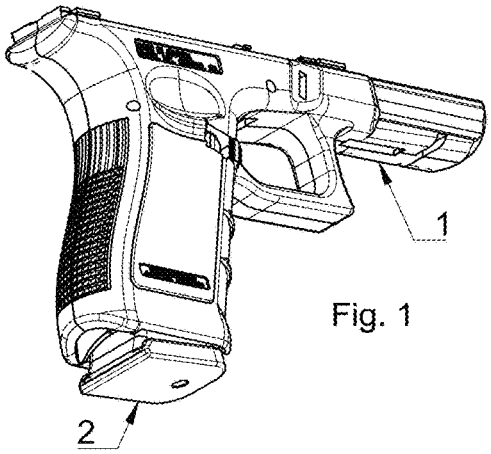
FIG. 1 is a rear-right-bottom isometric view of an embodiment of a RAMRS with a Magazine locked into a firearm Grip Frame.

FIG. 1 is a rear-right-bottom isometric view of an embodiment of a RAMRS with a Magazine 2 locked into a firearm Grip Frame 1.

Figure 2:
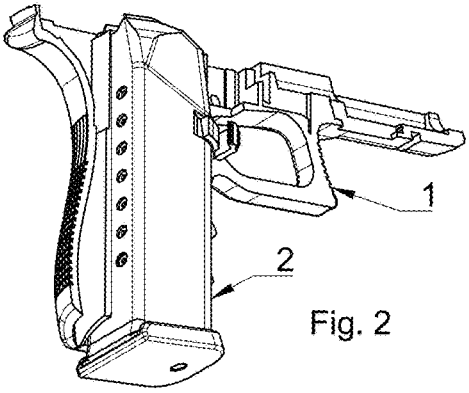
FIG. 2 is a same view as FIG. 1 but with Grip Frame cutaway in half (for illustrative clarity).

FIG. 2 is a same view as FIG. 1 but with Grip Frame 1 cutaway in half (for illustrative clarity).

Figure 3:
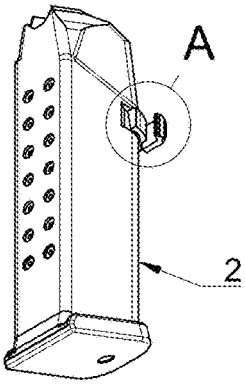
FIG. 3 is a same view as FIG. 2 but without the entire Grip Frame (for illustrative clarity) showing only the Magazine and the RAMRS in a "Magazine Secured State".

FIG. 3 is a same view as FIG. 2 but without the entire Grip Frame (for illustrative clarity) showing only Magazine 2 and RAMRS in a "Magazine Secured State".

Figure 4:
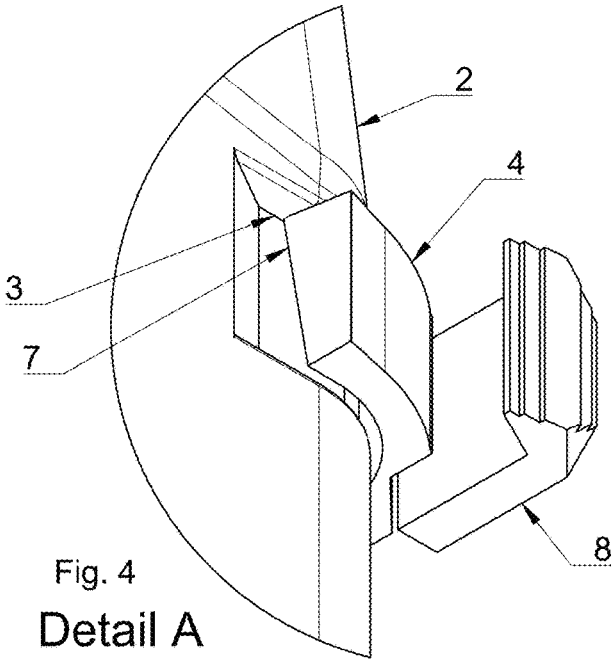
FIG. 4 is a detailed view of Section A of FIG. 3.

FIG. 4 is a detailed view of Section A of FIG. 3. Magazine 2 is secured/locked by the RAMRS. A Magazine Catch 7 of a Right Thumb Actuator 4 is engaged with a Catch Divot 3 of Magazine 2.

Figure 5:
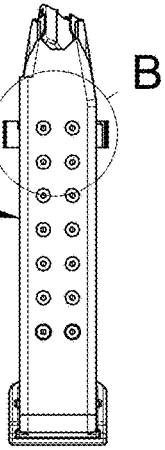
FIG. 5 is a rear view of FIG. 3.

FIG. 5 is a rear view of FIG. 3.

Figure 6:
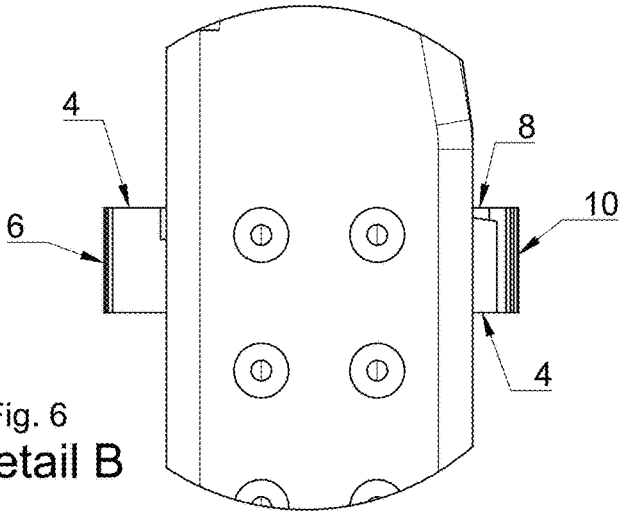
FIG. 6 is a detailed view of Section B of FIG. 5.

FIG. 6 is a detailed view of Section B of FIG. 5. Right Thumb Actuator 4 further comprises a Right Thumb Button 6. Left Thumb Actuator 8 further comprises a Left Thumb Button 10.

Figure 7:
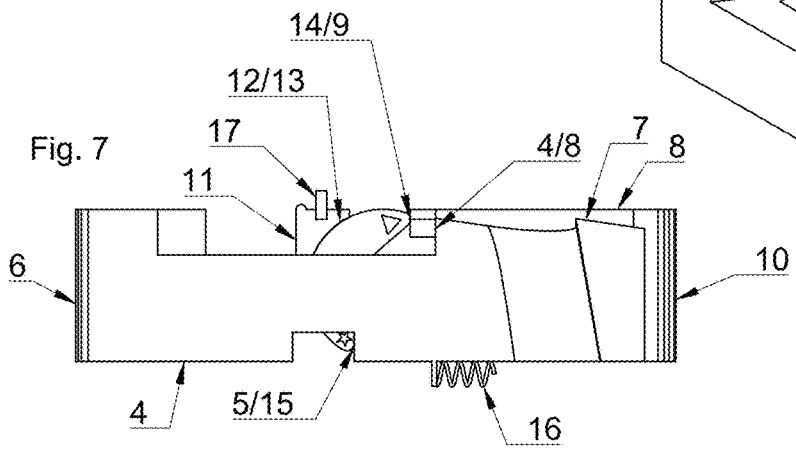
FIG. 7 is a same view as FIG. 5 but without the Magazine (for illustrative clarity) showing an assembled RAMRS.

FIG. 7 is a same view as FIG. 5 but without the Magazine (for illustrative clarity) showing an assembled RAMRS in the Magazine Secured State.

A Biasing Force Means 16 (a spring in this embodiment) biases Right Thumb Actuator 4 in a First (−X [to the left in these illustrations]) Direction. A Right Thumb Actuator Cam Face 5 transfers the biasing force via communication with a Bottom (star labeled for illustrative purposes) Lobe 15 of a Reciprocating Cam 13 which is nestled into a semicircular Cam Rotation Divot 12 of a Reciprocating Cam Bracket 11. Reciprocating Cam Bracket 11 further comprises a Wedge (17) which utilizes the force of the Biasing Force Means to wedge/anchor the Bracket into known (and thus not illustrated) features of the hollow Magazine Well of the Grip Frame. The biasing force is subsequently transferred in an Opposite (+X) Direction via a Top Lobe 14 (triangle labeled for illustrative purposes) of the Reciprocating Cam 13 to a Left Thumb Actuator Cam Face 9 of Left Thumb Actuator 8. Interference features (4/8 leader arrow) of the Actuators abut each other to properly position Magazine Catch 7.

Figure 8:
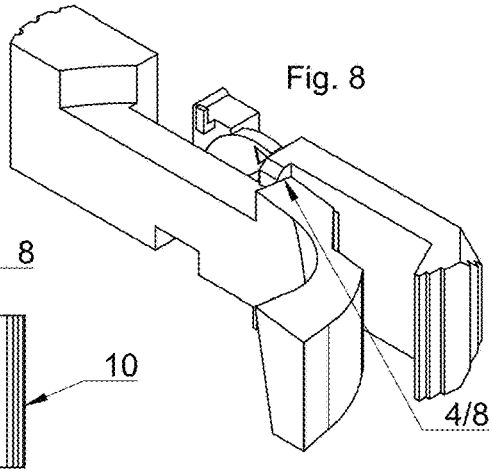
FIG. 8 is a rear-right-top isometric view of FIG. 7.

FIG. 8 is a rear-right-top isometric view of FIG. 7.

Figure 9:
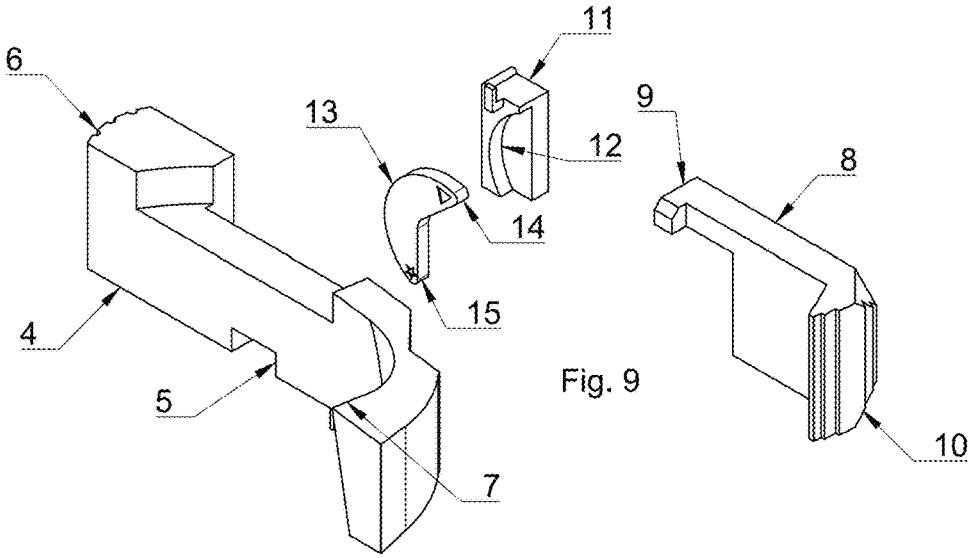
FIG. 9 is a rear-right-top exploded isometric view of the components of the RAMRS.

FIG. 9 is a rear-right-top exploded isometric view of the components of the RAMRS.

Figure 10:
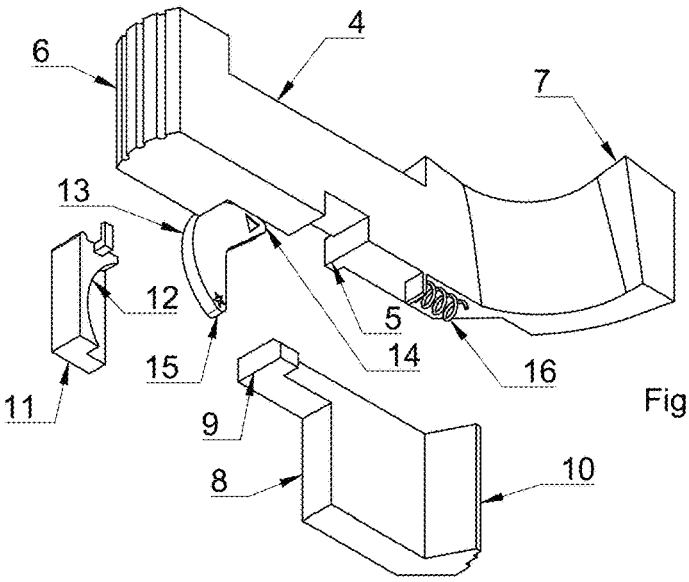
FIG. 10 is a rear-left-bottom isometric view of FIG. 9.

FIG. 10 is a rear-left-bottom isometric view of FIG. 9.

Figure 11:
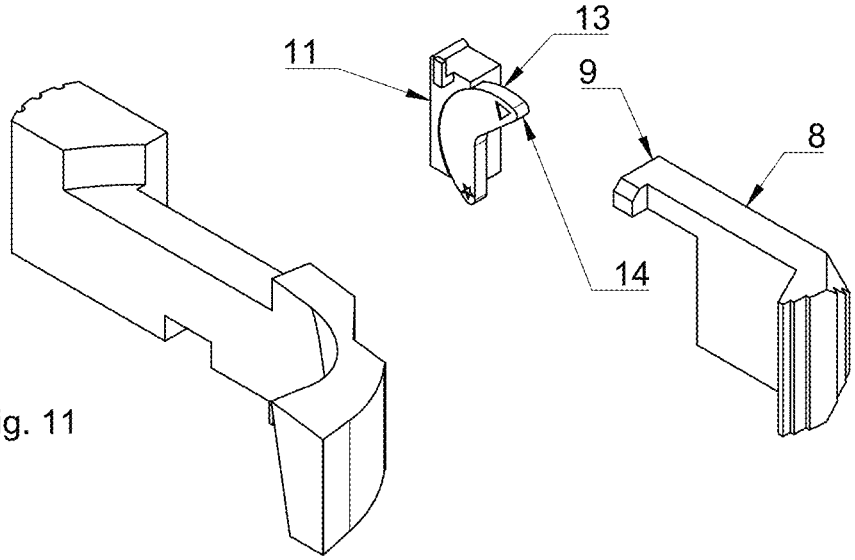
FIG. 11 is a rear-right-top semi exploded isometric view of the components of the RAMRS with its Reciprocating Cam nestled into its Reciprocating Cam Bracket.

FIG. 11 is a rear-right-top semi exploded isometric view of the components of the RAMRS with its Reciprocating Cam 13 nestled into its Reciprocating Cam Bracket 11.

Figure 12:
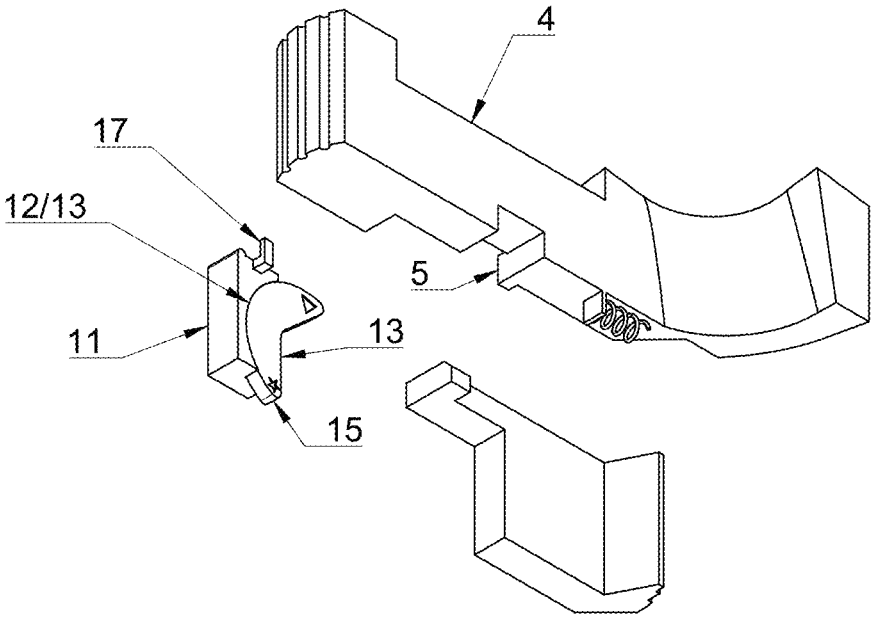
FIG. 12 is a rear-left-bottom isometric view of FIG. 11.

FIG. 12 is a rear-left-bottom isometric view of FIG. 11.

Figure 13:
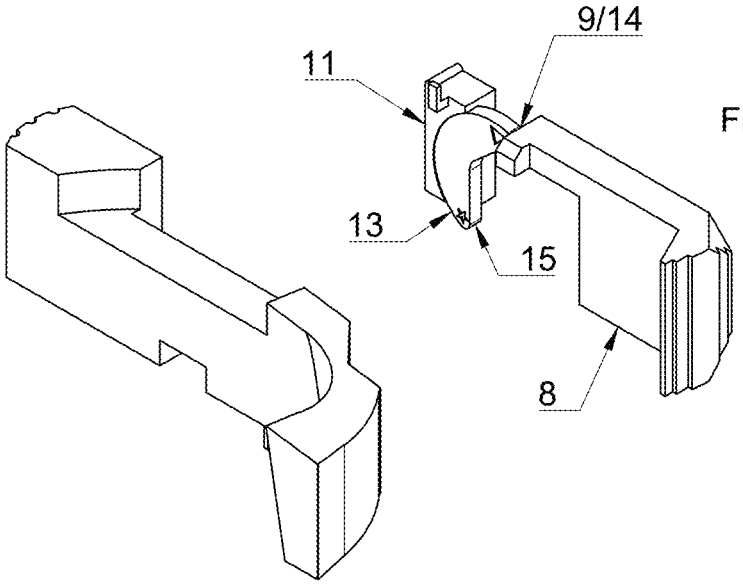
FIG. 13 is a rear-right-top semi exploded isometric view of the components of the RAMRS with its Reciprocating Cam nestled into its Reciprocating Cam Bracket and its Left Thumb Actuator abutted against a Top Lobe of the Reciprocating Cam.

FIG. 13 is a rear-right-top semi exploded isometric view of the components of the RAMRS with its Reciprocating Cam 13 nestled into its Reciprocating Cam Bracket 11 and its Left Thumb Actuator Cam Face 9 of Left Thumb Actuator 8 abutted against the Top Lobe 14 of Reciprocating Cam 13.

Figure 14:
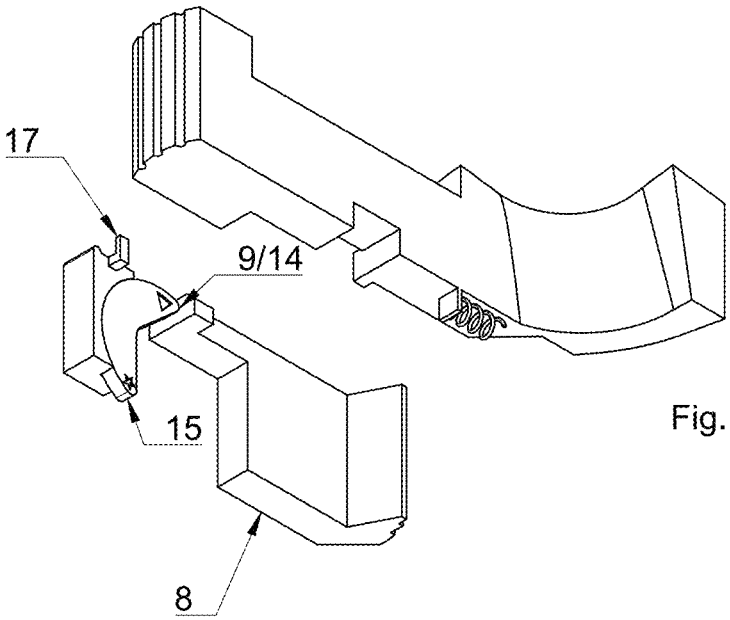
FIG. 14 is a rear-left-bottom isometric view of FIG. 13.

FIG. 14 is a rear-left-bottom isometric view of FIG. 13.

Figure 15:
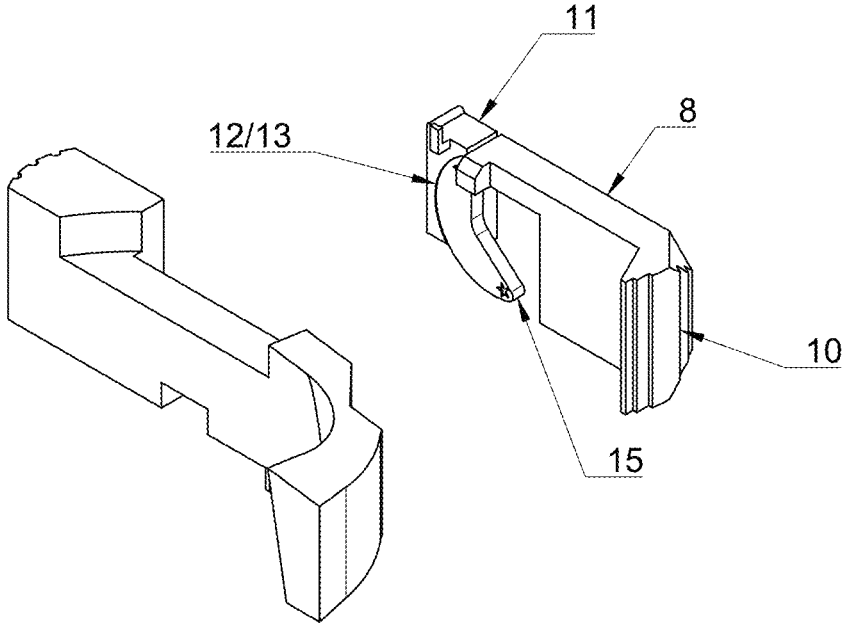
FIG. 15 is a rear-right-top semi exploded isometric view of the semi assembled components of FIG. 13 in a "Magazine Released State" with the Left Thumb Actuator displaced in a First Direction.

FIG. 15 is a rear-right-top semi exploded isometric view of the semi assembled components of FIG. 13 in a "Magazine Released State" with the Left Thumb Actuator 8 displaced in a First (−X) Direction.

Figure 16:
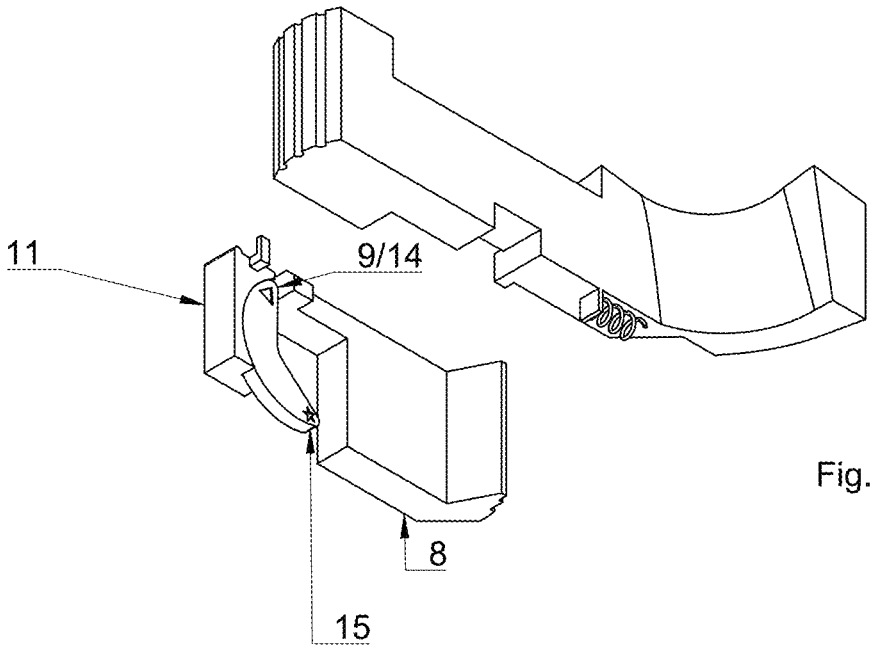
FIG. 16 is a rear-left-bottom isometric view of FIG. 15.

FIG. 16 is a rear-left-bottom isometric view of FIG. 15.

The crescent moon shaped Reciprocating Cam 13 twists/rotates about its flat face axis due to the interplay between the semicircular Cam Rotation Divot 12 of the Reciprocating Cam Bracket 11 and the Reciprocating Cam's 13 circumference, thus causing its Bottom Lobe 15 to displace in the Opposite (+X) Direction when its Top Lobe 14 is displaced in a First (−X) Direction.

Figure 17:
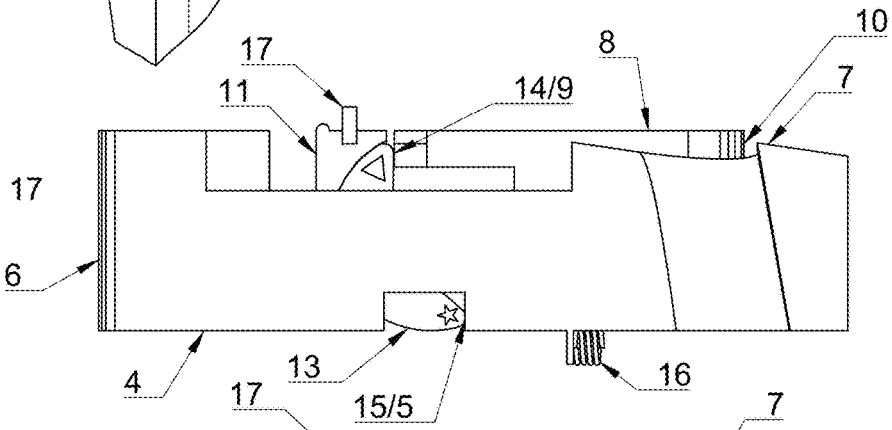
FIG. 17 is a rear view of the fully assembled RAMRS in a Magazine Released State.

FIG. 17 is a rear view of the fully assembled RAMRS in a Magazine Released State.

Figure 20:
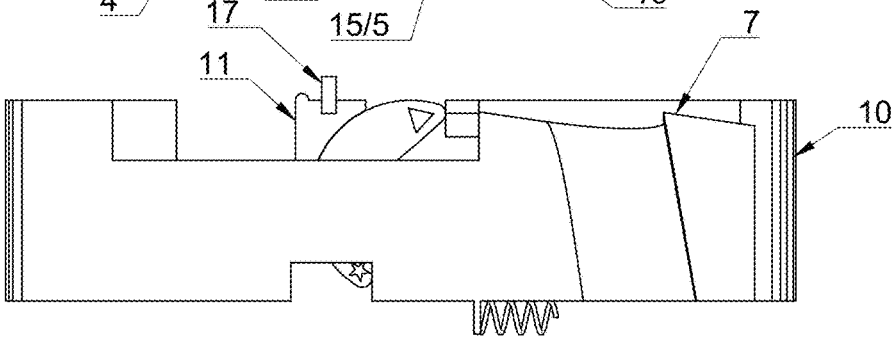
FIG. 20 is same as FIG. 7 (RAMRS in a Magazine Secured State) and is shown for comparison purposes.

FIG. 20 is same as FIG. 7 (RAMRS in a Magazine Secured State) and is shown for comparison purposes with its Reciprocating Cam Bracket 11 aligned vertically with the Reciprocating Cam Bracket 11 of FIG. 17.

Figure 21:
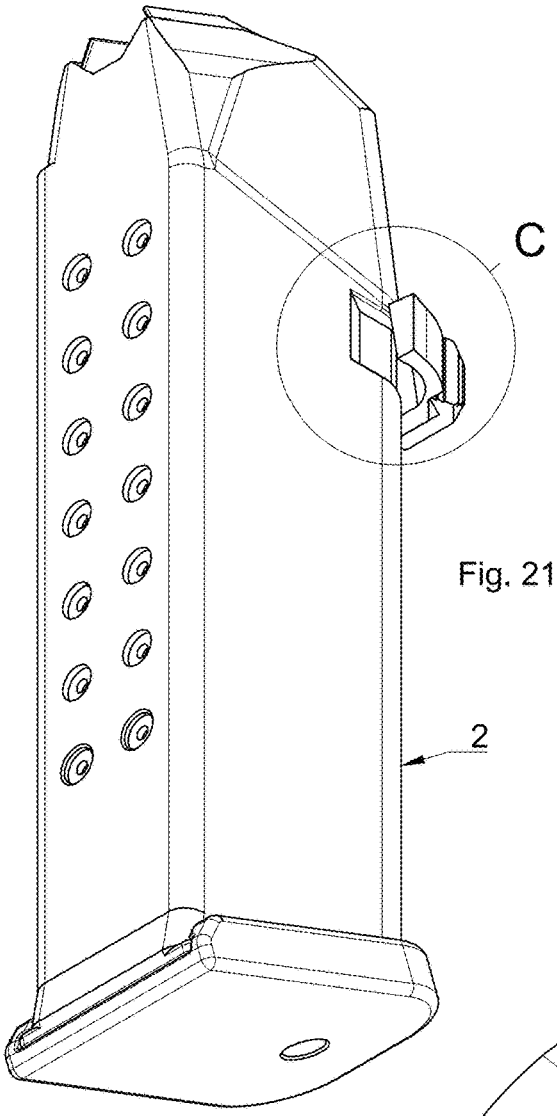
FIG. 21 is similar to FIG. 3 but with the RAMRS in a Magazine Released State.
Figure 22:
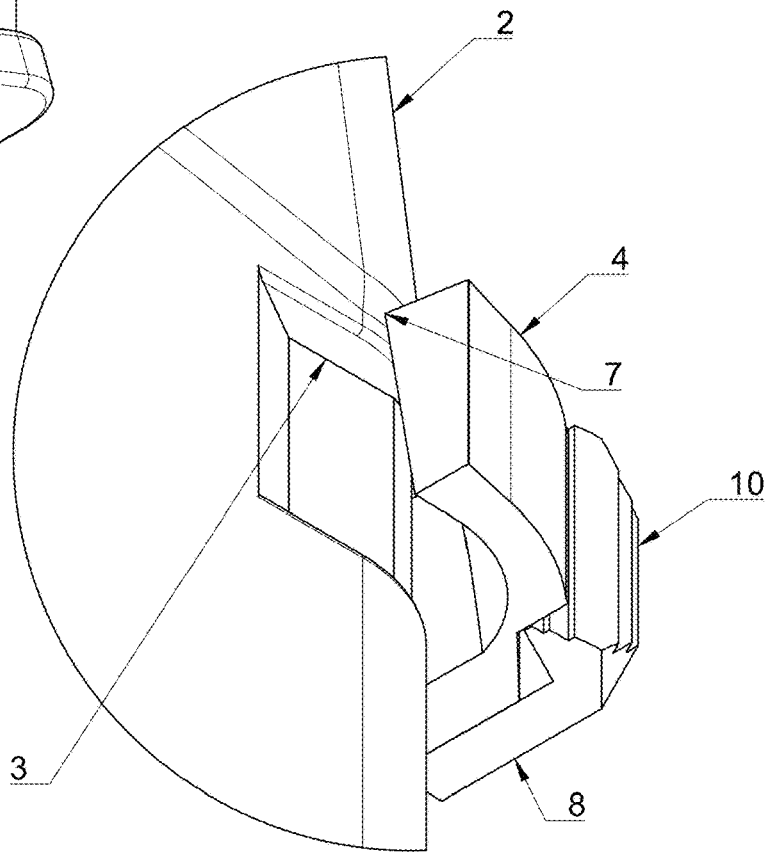
FIG. 22 is a detailed view of Section C of FIG. 21.

When Left Thumb Button 10 of Left Thumb Actuator 8 is pressed (against Biasing Force Means' 16 biasing force) by the left thumb in the First (−X) Direction, interplay between the components displaces Right Thumb Actuator 4 (and thus its integrated Magazine Catch 7) in the Opposite (+X) Direction to effect the system state of FIGS. 21 and 22.

Figure 18:
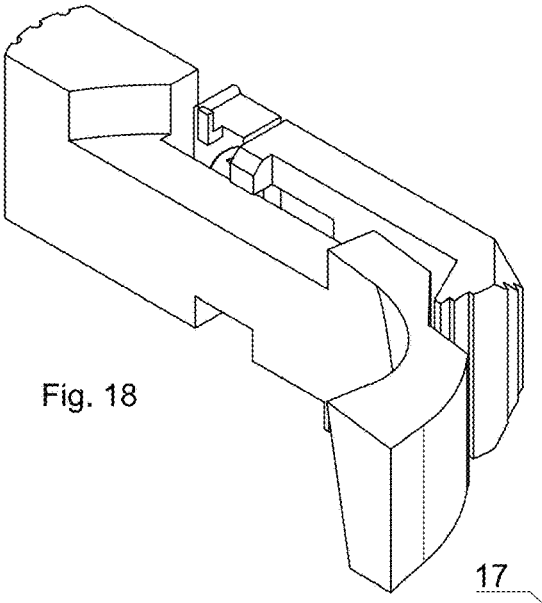
FIG. 18 is a rear-right-top isometric view of FIG. 17.

FIG. 18 is a rear-right-top isometric view of FIG. 17.

Figure 19:
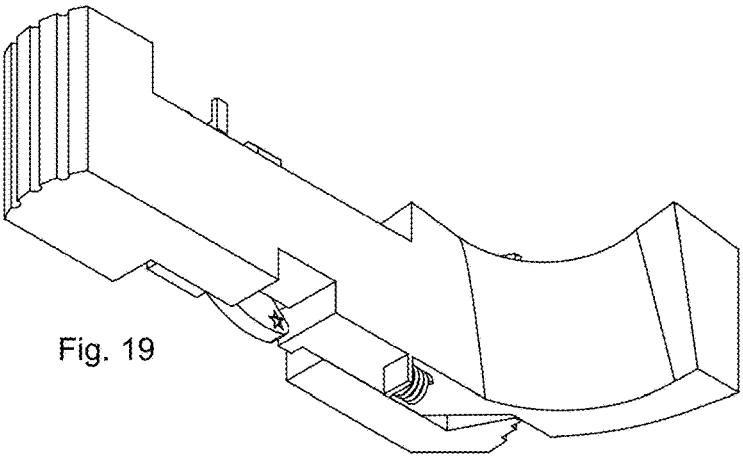
FIG. 19 is a rear-left-bottom isometric view of FIG. 17.

FIG. 19 is a rear-left-bottom isometric view of FIG. 17.

FIG. 21 is similar to FIG. 3 but with the RAMRS in a Magazine Released State.

FIG. 22 is a detailed view of Section C of FIG. 21. As similarly described for FIG. 4, the Magazine Catch 7 is clear of Catch Divot 3 thus allowing Magazine 2 to be ejected from the Grip Frame.

It is important to note that the Magazine Released State could be effected by the individual pressing of Left Thumb Button 10 or Right Thumb Button 6 or both Thumb Buttons (i.e.—6 and 10) being pressed simultaneously by a thumb and an opposing finger in a force multiplying pinching motion. This feature would allow users of limited hand/finger strength (i.e.—smaller handed or injured) to easily eject the magazine.

It is also important to emphasize that the invention could be configured as an easy "Drop-In" type of system/modification where no alteration (except for the "dropping in" of the parts) of the firearm from original factory configuration is required.

Although the described embodiment utilizes a coil compression spring, alternate embodiments could utilize other (i.e.—torsion, post, leaf, extension, etc,) types of springs. Alternate embodiments could utilize any suitable means (i.e.—adhesives, screws, etc.) to anchor/wedge the Reciprocating Cam Bracket into the Magazine Well. Furthermore, any means to effect a biasing force (i.e.—magnets, etc.) could be utilized.

It is contemplated that the components of the inventive subject matter described herein can be made from suitable materials (e.g.—sheet metal, steel, steel alloys, polymers (plastics), etc.) and processes (e.g.—machining, 3D Printing, Metal Injection Molding, sheet metal folding, etc.) known by those in the art.

Alternative embodiments and/or uses of the methods and devices described above and modifications and equivalents thereof are intended to be included within the scope of the present invention. These embodiments could include any objects which utilize easy assembly/disassembly methods (i.e.—screws, pins, cotter pins, partial turn locking means, magnets, locking washers, locking nuts, etc.).

Although only a semiautomatic handgun is described, the invention could be readily adapted to be utilized in alternate types of firearms (i.e.—(semi and fully automatic) rifles, shotguns, cannons, etc.).

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A firearm reciprocating ambidextrous magazine release system comprising:

a grip frame, a magazine, a reciprocating cam bracket, a reciprocating cam, a right thumb actuator, a left thumb actuator, and a biasing force means;

the grip frame further comprising a hollow magazine well configured to communicate with the magazine;

the magazine further comprising a catch divot;

the reciprocating cam bracket anchored within the magazine well and configured to communicate with the reciprocating cam to allow a reciprocating action of the reciprocating cam;

the reciprocating cam configured to communicate and move relative to both the right thumb actuator and the left thumb actuator to cause a translation of the left thumb actuator in a first direction to translate the right thumb actuator in a second direction opposite to the first direction, the right thumb actuator biased in the first direction by the biasing force means and further comprising a magazine catch configured to engage the catch divot to secure the magazine in the magazine well, the magazine catch further configured to disengage the catch divot when the right thumb actuator is translated in the second direction.

2. A firearm comprising the reciprocating ambidextrous magazine release system of claim 1.

* * * * *